US006125782A

United States Patent [19]

Takashima et al.

[11] Patent Number: 6,125,782

[45] Date of Patent: Oct. 3, 2000

[54] SMALL CRAFT WITH G.P.S.

[75] Inventors: Sumihiro Takashima; Yasukazu Kojima, both of Shizuoka, Japan

[73] Assignee: Yamaha Hatsudoki Kabushiki Kaisha, Japan

[21] Appl. No.: 09/153,022

[22] Filed: Sep. 15, 1998

[51] Int. Cl.[7] ..... B63B 17/00

[52] U.S. Cl. ..... 114/343; 114/55.57; 114/364

[58] Field of Search ..... 114/343, 364, 114/55.5, 55.57

[56] References Cited

U.S. PATENT DOCUMENTS

| | | | |
|---|---|---|---|
| 4,635,580 | 1/1987 | Nishida | 114/55.57 |
| 5,417,178 | 5/1995 | Harrelson, II | 114/343 |
| 5,491,636 | 2/1996 | Robertson et al. | 364/432 |
| 5,597,335 | 1/1997 | Woodland | 441/36 |
| 5,713,293 | 2/1998 | Shiffler et al. | 114/56 |
| 5,894,810 | 4/1999 | Orr | 114/55.5 |

*Primary Examiner*—Sherman Basinger
*Attorney, Agent, or Firm*—Bacon & Thomas PLLC

[57] ABSTRACT

A GPS-fitted small watercraft in which one or more GPS antennas are attached to the watercraft in a manner that provides good protection from waves and good signal reception. For a watercraft having a hull member and a deck member joined together at their perimeters, with a gunwale formed at and protruding outwardly from the joined perimeters, the GPS antenna(s) is mounted inwardly from the gunwale on the deck or hull member. Alternatively, the GPS antenna(s) may be mounted to an outside or inside surface of the deck member, on a pad located on a set of handlebars, near a grip of the handlebars, atop or inside a small cargo hatch, on a hatch beneath the handlebars, on a grab bar behind a seat of the watercraft, on a top surface of a bulwark, or on a side wall of the watercraft between the gunwale and a chine of the hull member, either on the inside or outside.

9 Claims, 2 Drawing Sheets

SMALL CRAFT WITH G.P.S.

BACKGROUND OF THE INVENTION

1. Field of the Invention

The present invention relates to small watercraft equipped with a GPS.

2. Description of the Related Art

Presently, small watercraft such as jet-propulsion watercraft are in wide-spread use. Since most of these watercraft are normally used to run at high speeds over a relatively small area, they do not use a positioning system.

However, the above-mentioned jet-propelled watercraft are also used as fishing boats, etc. This type of usage makes it necessary for them to travel from the shore over comparatively long distances. In that case, a need arises for the watercraft to be equipped with a positioning system. The adaptation of a GPS (Global Positioning System) to this application could be considered. A GPS device receives signals generated by earth satellites to detect its position, such as its latitude and longitude. Normally, such devices are composed of an antenna, a display, and a controller. When such a device is used on jet-propelled or other small watercraft, which may experience violent movement or be struck by waves, the antenna must be protected from the waves and positioned in a manner that improves its reliability in receiving signals.

SUMMARY OF THE INVENTION

The present invention was developed to address the foregoing issues and has as its objective a GPS-fitted small watercraft which provides good protection for the GPS antenna and improves its reliability in receiving signals.

The invention according to a first embodiment provides for GPS-fitted small watercraft comprising a hull member and deck member that are joined to each other around their perimeters, wherein the foregoing junction area in the watercraft forms a gunwale that protrudes from the perimeters. A GPS antenna is attached to the deck member inwardly from the gunwale. Here, what is meant by attaching the GPS antenna to the deck member is not limited to directly attaching the antenna to the deck member, as it may be attached indirectly on a bracket, hatch cover, etc.

The invention according to a second embodiment provides a GPS-fitted small watercraft having an opening formed in the perimeter of the deck member with a lid arranged to open and close over it. The GPS antenna is installed on an outside surface or an inside surface of this lid. Here, what is meant by a lid arranged to open and close the opening includes having the deck member be removable itself.

According to the second embodiment, the GPS antenna may be attached to the outside surface or the inside surface. An elastic gasket may be provided around the perimeter of the lid to buffer the GPS antenna from vibrations and shocks and thus to provide excellent longevity. Furthermore, when attached to the outside surface, the GPS antenna may be designed in such a way that improves the appearance of the watercraft. Or, when attached to the inside surface, it may be positioned so that the gasket seals the perimeter of the lid to protect the GPS antenna from waves and rain while the watercraft is operating.

The invention according to a third embodiment provides a GPS-fitted small watercraft wherein the GPS antenna is mounted to an elastic pad, which covers a middle of a set of steering handlebars, to improve the GPS antenna's longevity by protecting it from the watercraft's vibrations.

The invention according to a fourth embodiment attaches the GPS antenna to a grip of the handlebars or in the vicinity of the handlebars mounted upon the deck member. Normally, switches or meters are mounted on the handlebars. These switches or meters may be incorporated in an equipment console with the GPS antenna; however, it is also possible to attach the GPS antenna separately.

The invention according to a fifth embodiment mounts the GPS antenna on a top surface of or inside a small cargo hatch formed in the deck member.

The invention according to a sixth embodiment mounts the GPS antenna facing outwardly on a side surface of the deck member beneath the handlebars and in front of a straddling seat.

The invention according to a seventh embodiment mounts the GPS antenna on an outside surface or an inside surface of a grab bar that is installed on a rear of the straddling seat mounted on the watercraft.

The invention according to an eighth embodiment mounts the GPS antenna on an upper surface of a bulwark that is formed on foot rests on either side of the straddling seat.

In the invention according to a ninth embodiment, the antenna is mounted on the hull member beneath the gunwale and does not interfere with weight shifts made by the operator driving the watercraft. Because the antenna is mounted above a chine on the hull member, and thus above the water line when the watercraft is operating, the antenna is protected from shocks from the water surface.

According to a tenth embodiment of the invention, in watercraft having a hull member and a decking member joined around their perimeters, the GPS antenna may be mounted in a hollow space formed in the hull member and the deck member. Additionally, an inspection opening may be formed in the hull member or deck member in close proximity to the GPS antenna.

DETAILED DESCRIPTION OF THE PREFERRED EMBODIMENTS

Figure 1:
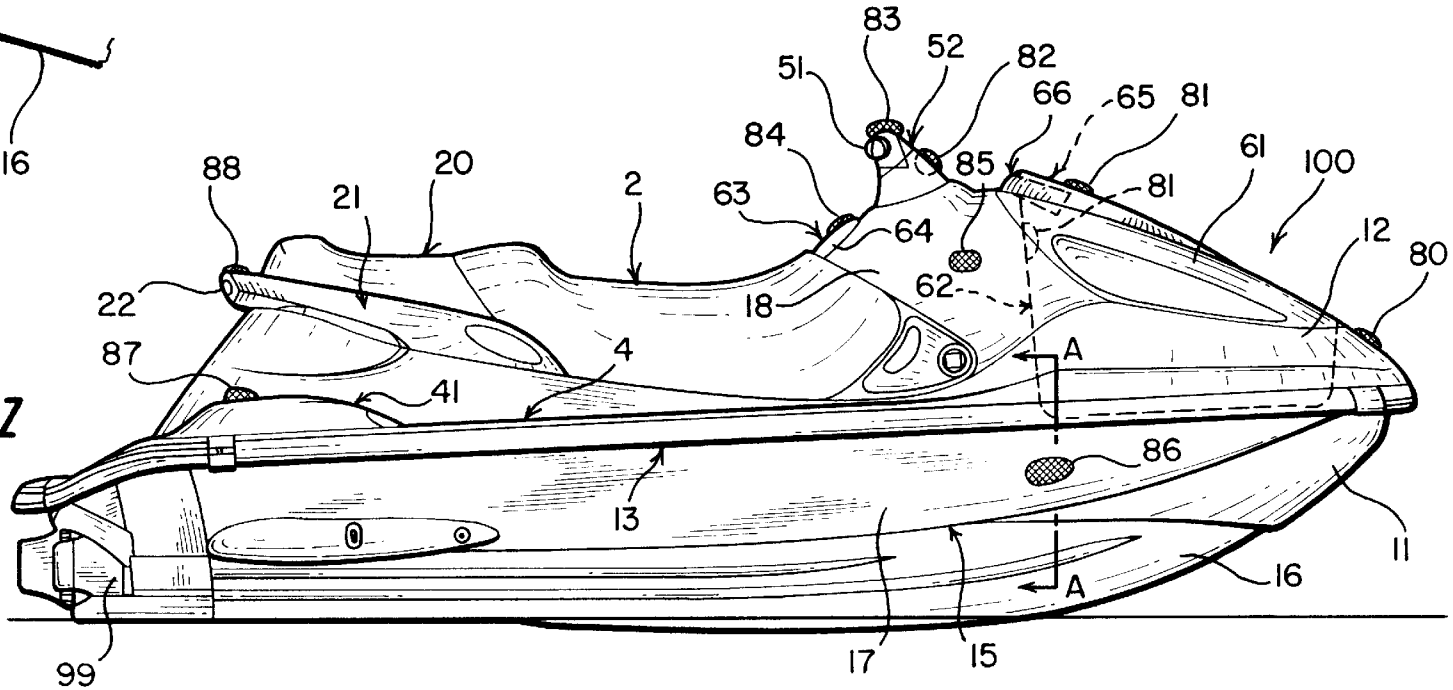
FIG. 1 is a side view of an embodiment of a watercraft according to the present invention.
Figure 3:
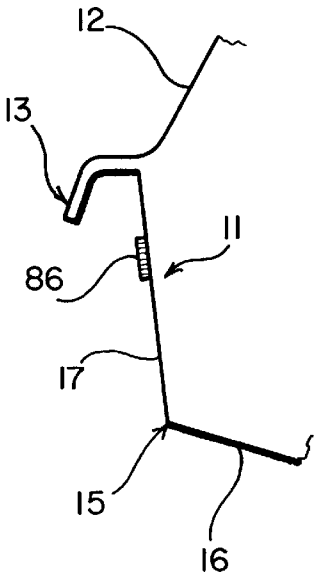
FIG. 3 is a sectional view taken along line A—A of FIG. 1.
Figure 2:
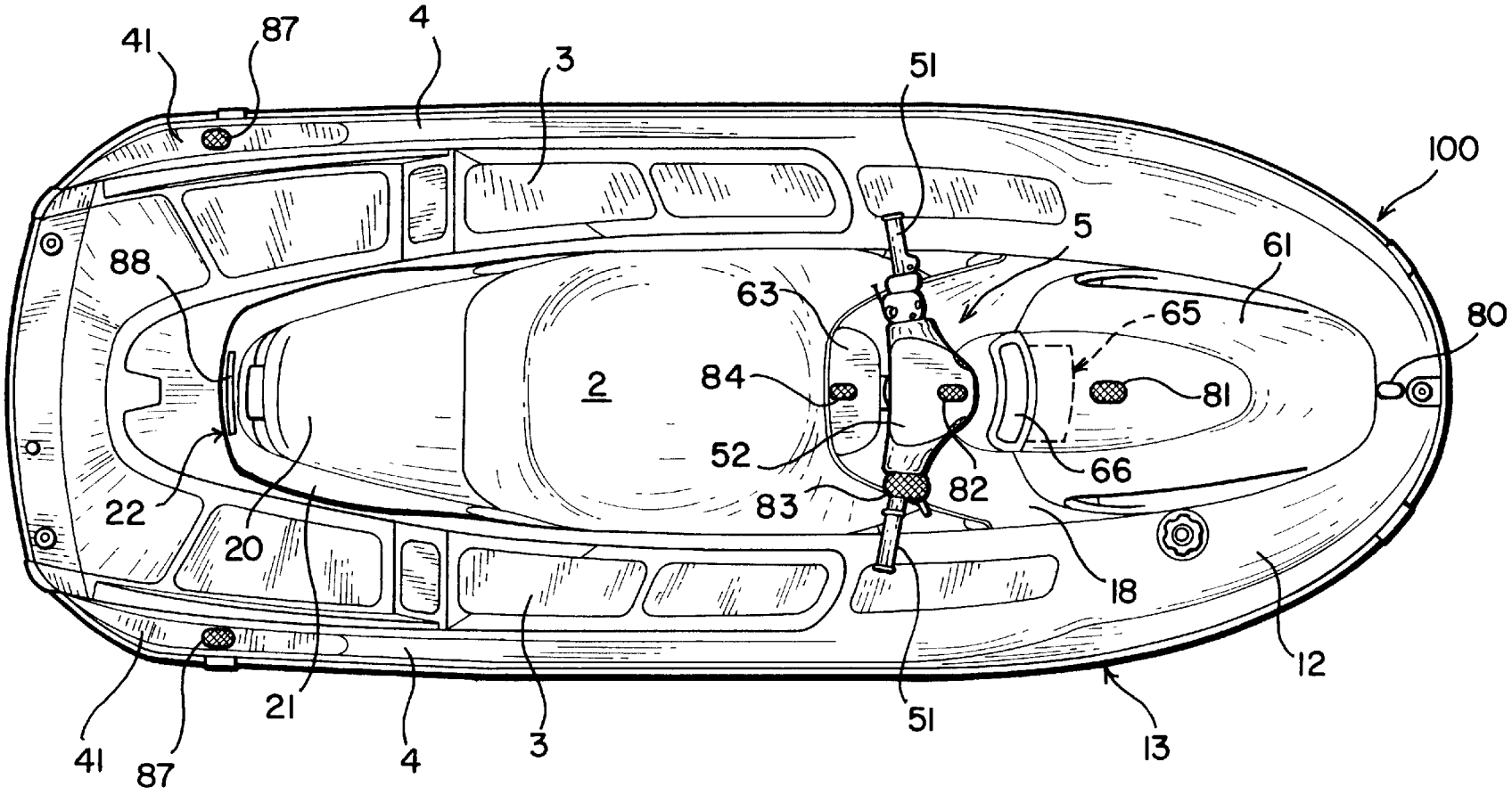
FIG. 2 is a top view of the watercraft shown in FIG. 1.

In the figures, a watercraft 100 comprises a hull member 11 and deck member 12, both made of FRP, which are fitted together around their perimeters. The watercraft 100 is equipped with a jet propulsion apparatus 99. The perimeters where the hull and deck members 11, 12 are joined comprises a gunwale 13. Further, a straddling seat 2 extends along the center line of the watercraft 100 from about the middle of the boat in the fore-aft direction toward the stern. A pair of steering handlebars 5 is disposed in front of the seat 2 and attached to a hatch 18. The hatch 18 is attached to the deck member 12 in a manner such that it can be opened and closed. Also, the handlebars 5 are preferably equipped with grips 51 on each side and a urethane or other type of elastic pad 52 attached at the center.

A cargo hatch 62 is formed in the deck member 12 in front of the handlebars 5. A hatch cover or lid 61 is attached to the deck member 12 to open and close over the cargo hatch 62. The hatch cover 61 may be sealed by a rubber sealing gasket disposed in a groove around its perimeter. A speedometer 65 is mounted on a lower rear edge of the hatch cover 61 in a manner such that its display side 66 faces an operator of the watercraft 100. There is also a storage area 64 formed in a center rear side of the handlebars 5. An opening at the top of the storage area 64 is equipped with a rubber gasket around its perimeter and another lid 63 which can be opened and closed. Advantageously, it is possible to incorporate a control unit, which processes signals received by an antenna 81 of the GPS, as well as a display for the processed signals into an integral module that includes the speedometer 65. It is also possible to incorporate only the display unit with the speedometer 65 and to position the control unit somewhere inside the watercraft 100. The latter method has the advantage of less exposure of the control unit to water contact.

Foot rests 3 are formed on both sides of the seat 2 with rear edges thereof open to the stern of the watercraft 100. Bulwarks 4 are formed on the outside of the foot rests 3. Also, a flat "U"-shaped grab bar 21 is attached to a rear bottom side of the seat 2 and spans around a rear portion thereof. The grab bar 21 has a grip area 22 to facilitate grasping thereof by a person in the water trying to get on the watercraft 100.

When the GPS is installed in a watercraft with the foregoing structure, there are numerous possible sites for attachment of the GPS antenna. One way is to attach a GPS antenna 80 to the deck member 12 near the bow. Another option is to attach the GPS antenna 81 to the lid 61 of the cargo hatch 62 at its transverse center. It is also possible to attach the GPS antenna 81 to the bottom surface of the lid 61 or to a back wall of the cargo hatch 62. Further, as another example, a GPS antenna 82 may be attached to the center pad 52 on the handlebars 5, possibly even embedded within the pad 52. A GPS antenna 83 may be mounted on the handlebars 5 near a base of the grip 51. A GPS antenna 84 may also be attached to the lid 63 over the storage area 64 located behind the handlebars 5; or, the antenna may be mounted on the underside of the lid 63 or inside the storage area 64. As further options, a GPS antenna 85 may be mounted on one or both sides of the hatch 18 attached to the handlebars 5 in such a manner that the GPS antenna(s) 85 projects outwardly near the bottom of the handlebars 5 in an area adjacent the thighs of an operator sitting in the seat 2. This GPS antenna 85 may also be attached to an inside surface of the hatch 18.

As even further examples, a GPS antenna 86 may be attached to a side wall 17 of the watercraft 100 located above a chine 15 of the hull member 11 but below the gunwale 13. It is also possible to attach the GPS antenna 86 to the inside of the side wall 17. A GPS antenna(s) 87 may also be mounted on top of protrusion(s) 41 on a rear side of the bulwarks 4 formed on the outside of the foot rests 3. The location of the GPS antenna 87 is not confined to the top of the protruding areas 41. It may also be mounted on top surfaces of other parts of the bulwarks 4 or a single antenna 87 may be mounted on the top surface of one or the other bulwark 4. As another example, a GPS antenna 88 may be attached over a grip area 22 on the back of the grab bar 21; or, the GPS antenna 88 may be contained inside the grab bar 21.

Also, although not shown in the figures, it is further possible to mount GPS antennas in a hollow area that may be created between the hull member 11 and the deck member 12. In this case, it is also desirable to form an inspection opening in the hull member 11 or the deck member 12 so that a person can reach the antennas. For example, the inspection opening could be formed on the top of the deck member 12 underneath seat 2, with seat 2 being removable.

With the above described structure, when the GPS antenna 80 is mounted inwardly from the gunwale 13 on top of the deck member 12, the GPS antenna 80 is unlikely to come into contact with water because it is shielded by the gunwale 13. This mounting is especially useful when the watercraft will be operated in high wave areas. Especially for ocean going watercraft, this method will help to prevent salt adhesion from corroding the GPS antenna 80.

Since the GPS antennas 81 and 84 are mounted upon either the top surface or the inside surface of the lids 61, 63, the elastic gasket material around the perimeter of the lids will attenuate any vibrations and will increase the longevity of the GPS antennas 81, 84. In particular, by removably attaching the GPS antenna 84 to the lid 63, it may be easily removed from the lid 63 and taken away for inspection or maintenance. In addition, when the GPS antennas 81, 84 are mounted on the outside surfaces of the lids 61, 63, the appearance of the watercraft is improved. When attached to the insides of the lids 61, 63, the seal around the lid perimeter provided by the gasket material keeps waves and rain off the GPS antennas 81, 84 while the watercraft 100 is operated.

Also, the placement of the GPS antenna 82 on the cushioning pad 52 in the middle of the handlebars 5 will buffer vibrations, improving the longevity of the GPS antenna 82. Further, since this pad 52 is much higher than the surface of the water, it is less likely to be hit by splashes while operating the watercraft 100. Further, this high position on the watercraft assures good signal reception by the GPS antenna 82.

Further, the placement of the GPS antenna 83 at a location high above the water line on the handlebars 5 near the grip 51 makes it less likely that water will splash upon it during operation of the watercraft 100. This high mounting position also has the advantage of allowing good reception by the GPS antenna 83.

In addition, the location of the GPS antenna 85 provides an advantage in that the operator driving the watercraft 100 may rest his leg against the GPS antenna 85 and use it as a support to facilitate weight shifting during turns or other maneuvers.

Further, since the operator places his feet on the foot rests 3 on either side of the seat 2, the mounting of the GPS antenna 87 on the top surface of the bulwark 4 on the outside of the foot rests 3 assures that the GPS antenna 87 is not in the way when the operator is turning and shifting his body weight. Further, good signal reception by the GPS antenna 87 results from the high mounting position on the top surface of the bulwark 4.

Also, the GPS antenna 88 mounted on the outside surface of the grab bar 21 and protruding therefrom helps prevent a person's grip from slipping when holding on to the grab bar 21. The mounting of GPS antenna 88 on the outside surface of the grab bar 21, or housing it inside the grab bar 21, provides a high position for good reception. Furthermore, since the grab bar 21 is strongly attached to the deck member 12, mounting the GPS antenna 88 to the grab bar 21 provides secure mounting.

Since the GPS antenna 86 is mounted beneath the gunwale 13, it does not interfere with the operator shifting his body weight. Because most of the contact of the watercraft 100 with the water occurs below the chine 15 during operation, attachment of the GPS antenna 86 to the hull member 11 above the chine 15 reduces the likelihood of impact forces from the water against the GPS antenna 86. When the GPS antenna is mounted on the inside of the hull member 11 or the deck member 12, it will not interfere with the operator shifting weight during turns and maneuvering.

An inspection opening on top of the watercraft 100 may then be provided for easy inspection and maintenance of the GPS antenna.

The invention according to the first embodiment mounts the GPS antenna 80 on the deck member 12 inside the gunwale 13 to shield it from water splashes while the watercraft 100 is running. This mounting is particularly advantageous for watercraft operating in high-wave environments. The attachment of the GPS antenna 80 to the deck member 12 in this manner does not have to be a direct attachment, but may be an indirect attachment by a bracket or upon a hatch cover.

The invention according to the second embodiment mounts the GPS antenna 81, 84 on the outside surface or the inside surface of the hatch lid 61, 63. Through the use of an elastic gasket around the perimeter of the lid 61, 63, vibrations transmitted to the GPS antenna 81, 84 are buffered to increase its longevity. Further, when attached to the outside surface, the GPS antenna 81, 84 can improve the appearance of the watercraft 100. When attached to the inside surface, the GPS antenna 81, 84 is shielded from contact with water by the gasket around the lid 61, 63, thereby leaving it unaffected by waves or rain when the watercraft 100 is operating.

The invention according to the third embodiment mounts the GPS antenna 82 to the elastic member or pad 52 that covers the center area of the handlebars 5 so that the pad 52 absorbs vibrations from the watercraft 100, thereby improving the longevity of the GPS antenna 82. In addition, since the pad 52 is high above the water level, the GPS antenna 82 is less likely to be hit by waves when the watercraft 100 is operated. This high positioning further provides for good signal reception by the GPS antenna 82.

The invention according to the fourth embodiment mounts the GPS antenna 83 on the handlebars 5 high above the water surface to protect it from waves and to improve the signal reception by the GPS antenna 83. In general, switches or gages are also mounted on the handlebars 5, and the GPS antenna 83 may be incorporated into an overall instrument unit or may be mounted separately.

The invention according to the fifth embodiment has the advantage of protecting the GPS antenna from waves and rain while the watercraft is operating.

The invention according to the sixth embodiment utilizes the mounting of the GPS antenna 85 to support the legs of the operator so as to enhance his ability to shift his body weight when making turns, etc.

The invention according to the seventh embodiment mounts the GPS antenna 88 on the outside surface of the grab bar 21. The GPS antenna 88 projects therefrom to function as a stop to prevent a person's hand from slipping off the grab bar 21. In addition, the GPS antenna 88 may be housed inside the grab bar 21; but, in either case, the mounting height assures good signal reception. Also, because the grab bar 21 is strongly attached to the watercraft 100, the GPS antenna 88 is strongly secured as well.

The invention according to the eighth embodiment mounts the GPS antenna 87 on the top surface of the bulwarks 4 formed around the outside perimeter of the foot rests 3 that are located on either side of the seat 2. This mounting keeps the GPS antenna 87 from interfering with weight shifts by the operator when making turns. Further, the high mounting position on the top of the bulwark 4 allows the GPS antenna 87 to have good signal reception.

The invention according to the ninth embodiment mounts the GPS antenna 86 on the hull member 11, taking advantage of the fact that while operating the area of most water contact is below the chine 15. Thus, by mounting it between the chine 15 and the gunwale 13, the GPS antenna 86 is protected from impact with the water surface.

The invention according to the tenth embodiment makes it possible to protect the GPS antenna from the wind and the rain, to keep it out of the way when the operator is shifting weight to make turns, and to maintain and inspect the GPS antenna easily.

What is claimed is:

1. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

an opening formed in said deck member;

a lid mounted on said deck member, said lid being arranged to open and close said opening;

wherein said GPS antenna is installed on a surface of said lid.

2. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

a set of rudder steering handlebars mounted in said deck member; and a pad covering a middle of said steering handlebars;

wherein said GPS antenna is attached to said pad.

3. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

a set of rudder steering handlebars mounted in said deck member;

wherein said GPS antenna is attached near said steering handlebars.

4. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

a small cargo hatch formed in said deck member;

wherein said GPS antenna is attached to said cargo hatch.

5. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

a straddling seat mounted in said deck member;

a set of rudder steering handlebars mounted in said deck member in front of said seat;

wherein said GPS antenna is attached to a side surface of said deck member located below said steering handlebars and faces outwardly said side susrface.

6. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

a straddling seat mounted in said deck member; and a grab bar mounted on a rear end of said seat;

wherein said GPS antenna is mounted on a surface of said grab bar.

7. A GPS-fitted small watercraft, comprising:

a hull member having a perimeter;

a deck member having a perimeter, said deck member being joined to said hull member around said perimeter;

a gunwale formed at said joined perimeters;

a GPS antenna installed on said deck member inwardly from said gunwale;

a straddling seat mounted in said deck member;

foot rests formed on each side of said seat; and a bulwark formed on an outside of each of said foot rests;

wherein said GPS antenna is installed on a top surface of at least one of said bulwarks.

8. A GPS-fitted small watercraft, comprising:

a hull member having a perimeter and a chine;

a deck member also having a perimeter, said deck member being joined to said hull member around said perimeters;

a gunwale formed at said joined perimeters and protruding outwardly therefrom; and a GPS antenna installed on an outer surface of said hull member between said gunwale and said chine.

9. A GPS-fitted small watercraft, comprising:

a hull member having a perimeter;

a deck member also having a perimeter, said deck member being joined to said hull member around said perimeters;

an internal cavity formed in said hull and deck members;

a GPS antenna installed in said internal cavity; and an inspection opening formed in at least one of said hull and deck members in close proximity to said GPS antenna.

* * * * *